US006997754B2

(12) United States Patent
Wan et al.

(10) Patent No.: US 6,997,754 B2
(45) Date of Patent: Feb. 14, 2006

(54) ELECTRICAL CONNECTOR ASSEMBLY WITH LOW CROSSTALK

(75) Inventors: Qing Wan, Kunsan (CN); Qisheng Zheng, Kunsan (CN); Wen Feng Deng, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/840,876

(22) Filed: May 7, 2004

(65) Prior Publication Data

US 2004/0224564 A1 Nov. 11, 2004

(30) Foreign Application Priority Data

May 7, 2003 (TW) ..... 92208376 U

(51) Int. Cl.
*H01R 24/00* (2006.01)
*H01R 13/648* (2006.01)
*H01R 13/60* (2006.01)

(52) U.S. Cl. ..... 439/676; 439/607; 439/541.5

(58) Field of Classification Search ..... 439/676, 439/607, 541.5, 608, 609, 95, 941
See application file for complete search history.

(56) References Cited

U.S. PATENT DOCUMENTS

| | | | | |
|---|---|---|---|---|
| 5,339,107 | A | 8/1994 | Henryi et al. | |
| 5,399,107 | A | 3/1995 | Gentry et al. | |
| 5,674,093 | A | 10/1997 | Yaden | |
| 5,779,503 | A | 7/1998 | Tremblay et al. | |
| 6,155,872 | A * | 12/2000 | Wu | 439/541.5 |
| 6,227,911 | B1 * | 5/2001 | Boutros et al. | 439/620 |
| 6,332,810 | B1 | 12/2001 | Bareel | |
| 6,419,526 | B1 * | 7/2002 | Fair et al. | 439/676 |
| 6,685,505 | B1 * | 2/2004 | Espenshade et al. | 439/541.5 |
| 6,733,332 | B1 * | 5/2004 | Espenshade et al. | 439/541.5 |
| 6,736,673 | B1 * | 5/2004 | Simmons et al. | 439/541.5 |
| 6,739,912 | B1 * | 5/2004 | Korsunsky et al. | 439/620 |
| 6,786,772 | B1 * | 9/2004 | Liu | 439/620 |
| 6,835,092 | B1 * | 12/2004 | Wan et al. | 439/541.5 |
| 2003/0077942 | A1 * | 4/2003 | Givens et al. | 439/620 |
| 2003/0087555 | A1 * | 5/2003 | Korsunsky et al. | 439/620 |

* cited by examiner

*Primary Examiner*—Chandrika Prasad
(74) *Attorney, Agent, or Firm*—Wei Te Chung

(57) ABSTRACT

An electrical connector assembly (100) is mounted on a motherboard and includes an insulative housing (1) having at least two receiving cavities (110, 111) and an insert module (200) secured to the housing. The insert module includes an insulator (2), a first and a second terminal modules (4, 5) received in the insulator and a ground plate (3) secured between the first and the second terminal modules.

8 Claims, 6 Drawing Sheets

ELECTRICAL CONNECTOR ASSEMBLY WITH LOW CROSSTALK

BACKGROUND OF THE INVENTION

1. Field of the Invention

The present invention relates to electrical connectors and more particularly, to a multi-port electrical connector assembly having a plurality of plug-receiving cavities for receiving a plurality of mating plugs.

2. Description of the Related Art

Modular jacks are well known used in two broad categories of signal transmission: analog (voice) and digital (data) transmission. These categories can overlap somewhat since digital systems are used for voice transmission as well. Nevertheless, there is a significant difference in the amount of data transmitted by a system per second. A low speed system would ordinarily transmit from about 10 to 16 megabites per second (Mbps), while a high-speed system should be able to handle 155 Mbps or even higher data transfer speeds. Often, high speed installations are based on asynchronous transfer mode transmission and utilize shielded and unshielded twisted pair cables.

With recent increases in the speed of data transmission, requirements have become important for electrical connectors, in particular, with regard to the reduction or elimination of crosstalk. Crosstalk is a phenomenon in which a part of the electromagnetic energy transmitted through one of multiple conductors in a connector causes electrical currents in the other conductors.

Another factor which must be considered is that the telecommunications industry has reached a high degree of standardization in modular jack design, and modular jacks are quite small or miniaturized. Various approaches have been made to eliminate or reduce the crosstalk, such as providing different configuration of adjacent contacts of modular jacks, coupling various types of filters, such as a three-terminal capacitor or a common mode choke coil, to reduce or eliminate noise. U.S. Pat. Nos. 5,399,107, 5,674,093 and 5,779,503 are examples of various connectors including jacks and plugs which attempt to address the problem of crosstalk between the contacts in telecommunications connectors. Outlines and contact areas are essentially fixed and have to be interchangeable with other designs. It is, therefore, important that any novel modular jack allow with only minor modification, the use of conventional parts or tooling in its production.

It is desired to improve performance of the modular jacks where crosstalk problems increase as higher frequencies are transmitted through the connector and which may be manufactured using conventional parts and tooling.

BRIEF SUMMARY OF THE INVENTION

A main object of the present invention is to provide a modular jack with low crosstalk electrical signal transmission.

Another object of the present invention is to provide a modular jack having simplified structure and lower cost.

An electrical connector is mounted on a motherboard and includes an insulative housing having at least at least two receiving cavities and an insert module secured to the housing. The insert module includes an insulator, a first and a second terminal modules received in the insulator and a ground plate secured between the first and the second terminal modules.

Other objects, advantages and novel features of the invention will become more apparent from the following detailed description when taken in conjunction with the accompanying drawings.

DETAILED DESCRIPTION OF THE INVENTION

Figure 1:
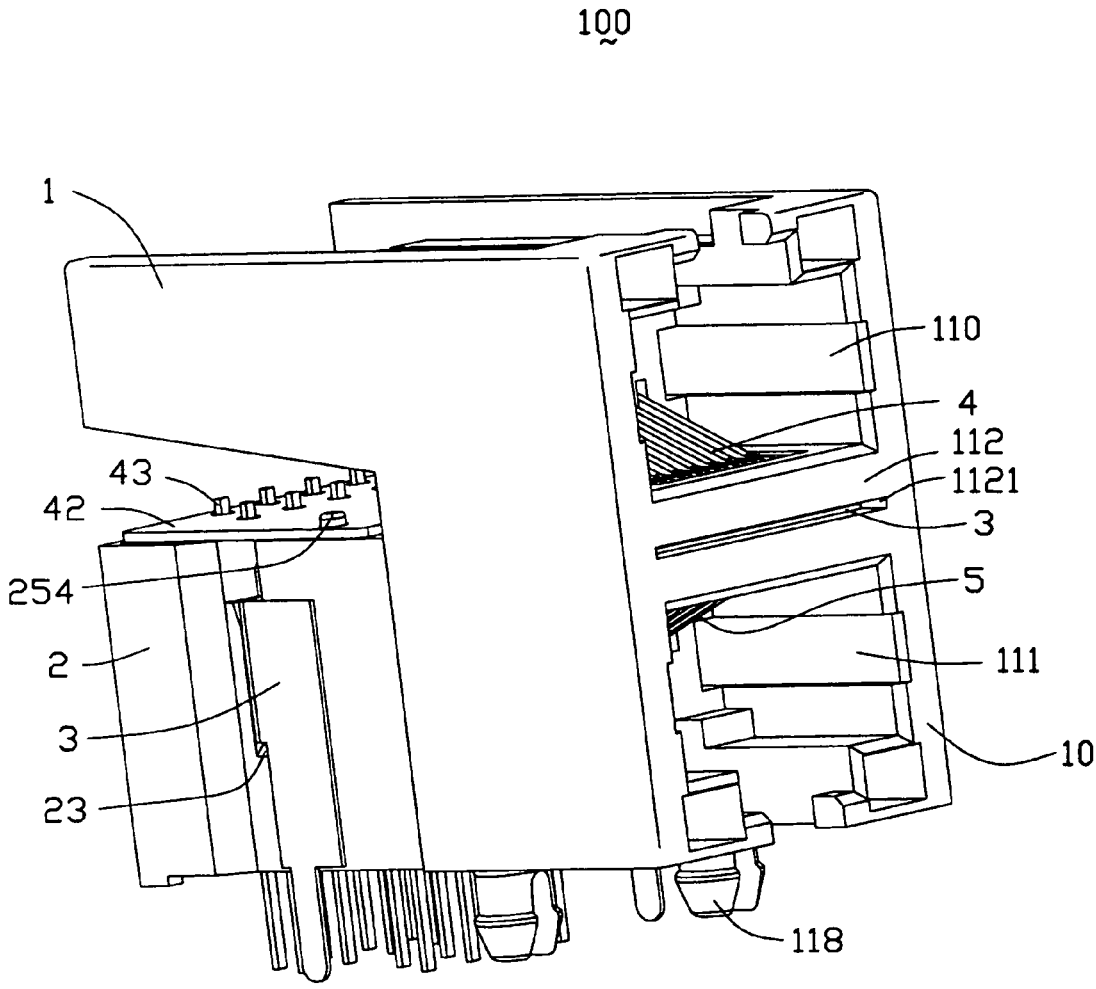
FIG. 1 is a perspective view of an electrical connector assembly according to the present invention.
Figure 2:
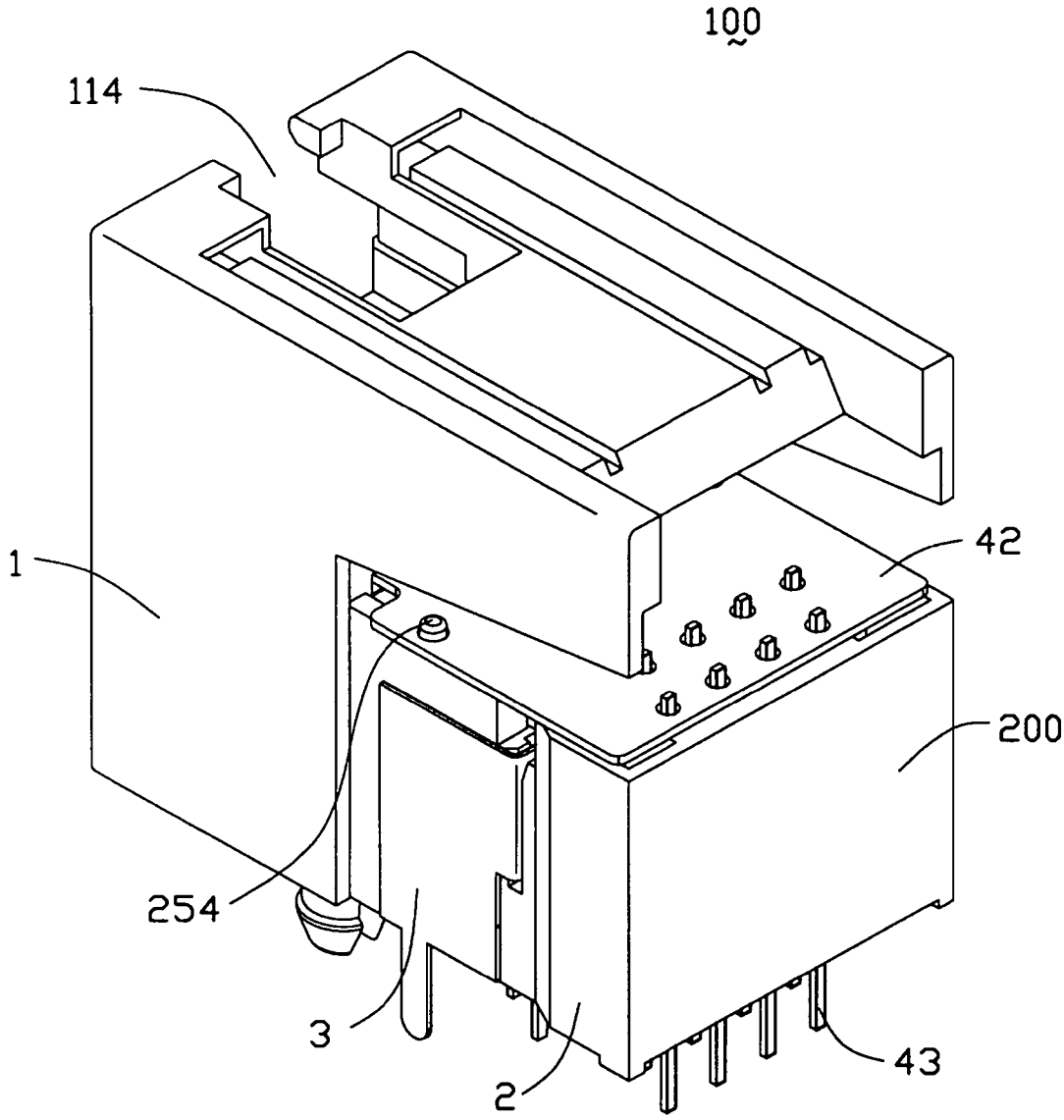
FIG. 2 is another perspective view of FIG. 1 from a rear aspect.

Referring to FIGS. 1 and 2, an electrical connector assembly 100 of the present invention, mounted on a motherboard (not shown), includes a molded insulative housing 1 and an insert module 200 disposed in the housing 1.

Figure 3:
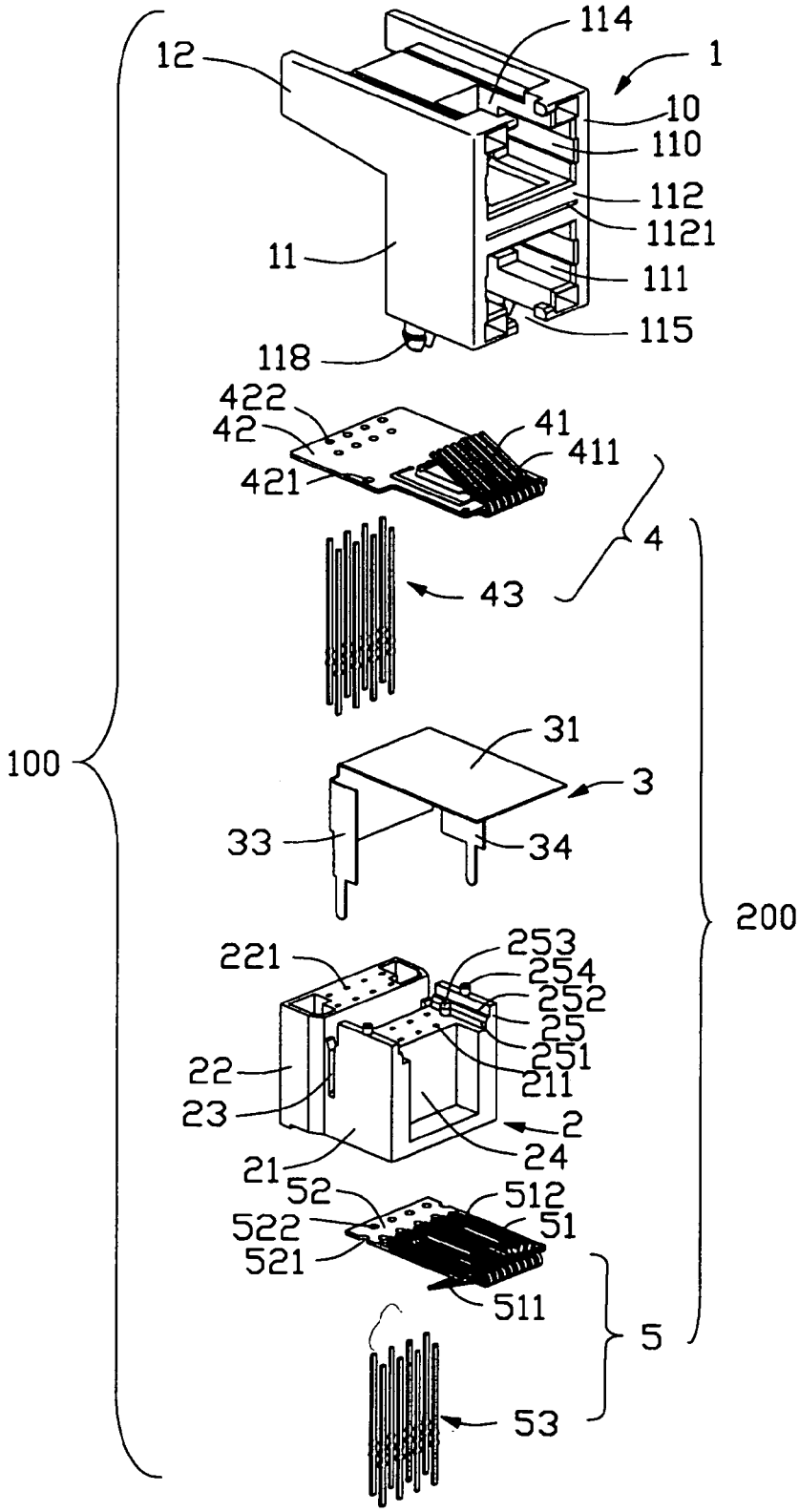
FIG. 3 is an exploded view of FIG. 1.
Figure 4:
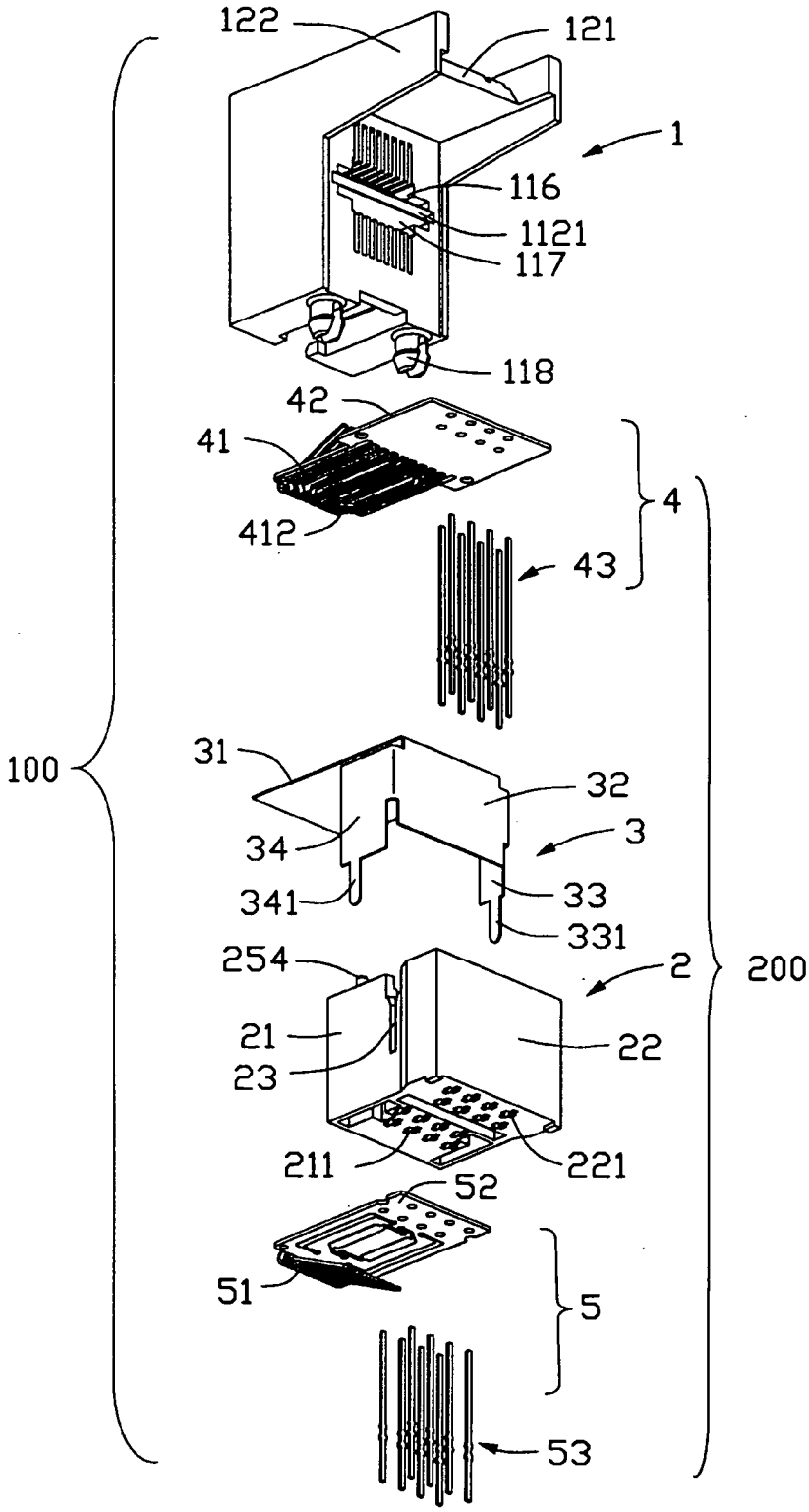
FIG. 4 is another exploded view of FIG. 1 from a rear aspect.
Figure 5:
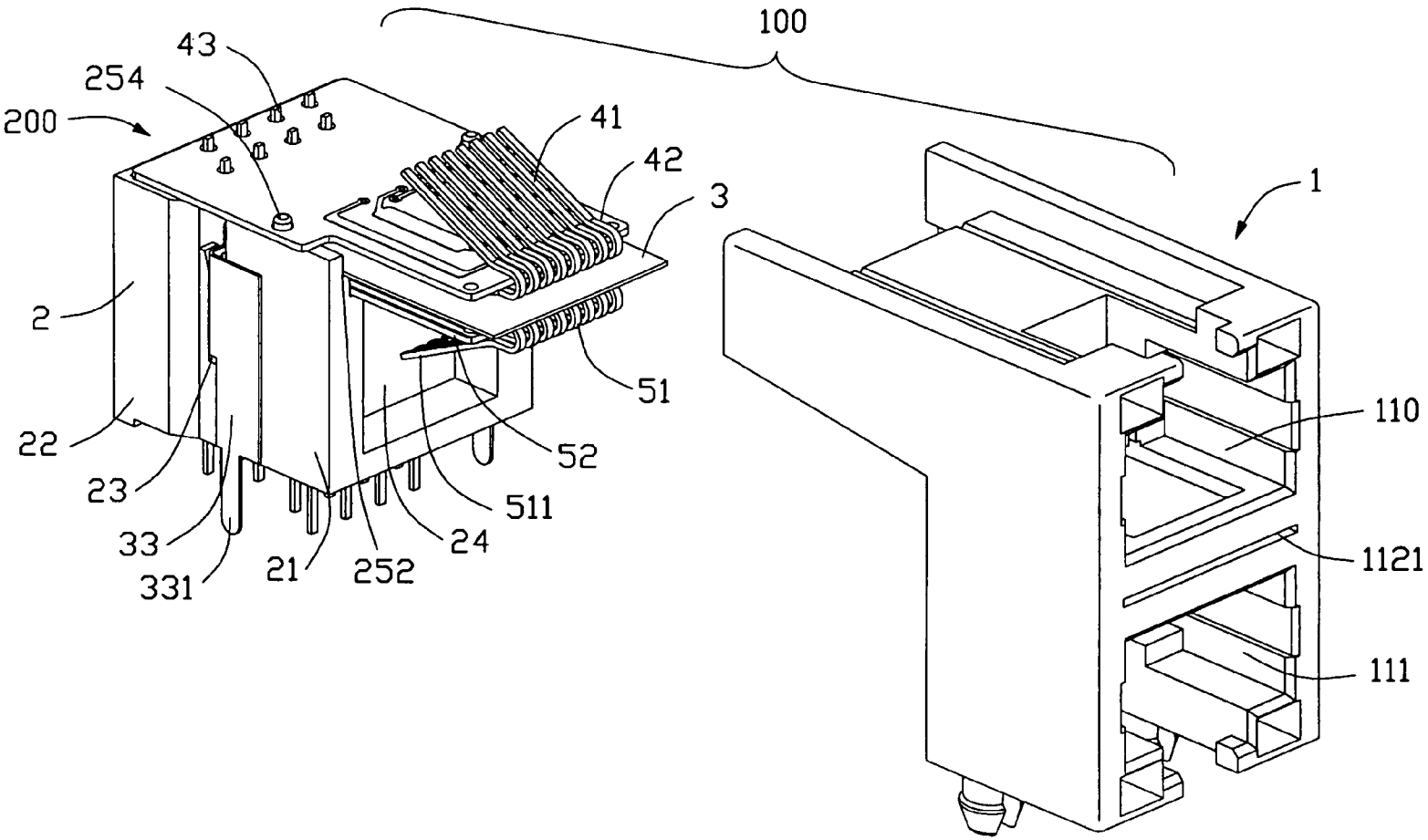
FIG. 5 is a partially assembled view of FIG. 2 taken from a front aspect, wherein an insert module is assembled.
Figure 6:
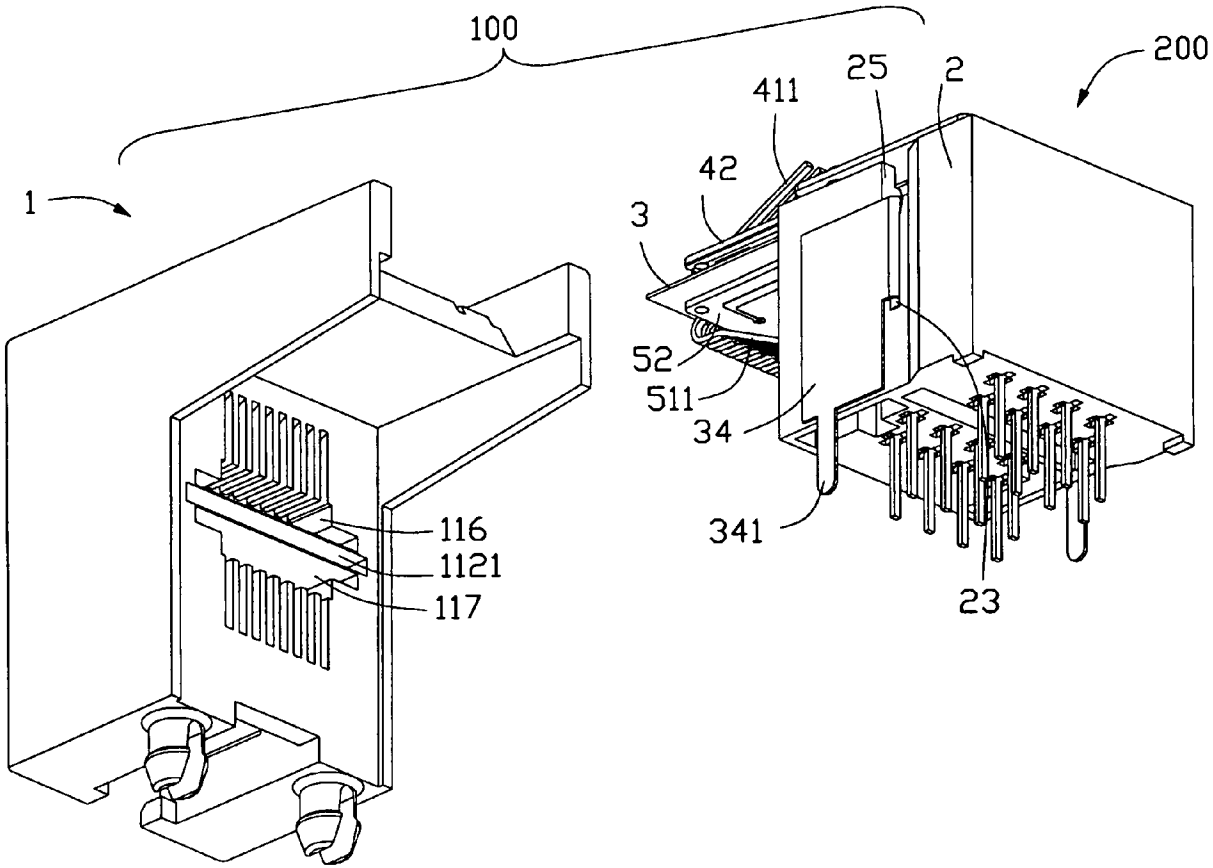
FIG. 6 is another assembled view of FIG. 5 taken from a rear aspect.

With reference to FIGS. 3 and 4, the housing 1 includes a mating face 10, a base portion 11 and an extending portion 12 extending rearwardly from the base portion 11. The base portion 11 defines an upper and lower receiving cavities 110, 111 exposed in the mating face 10. The upper and lower receiving cavities 110, 111 share a panel 112 which defines a slot 1121 therethrough. The base portion 11 includes a first and a second openings 114, 115 communicating with upper and lower receiving cavities 110, 111 respectively on upper and bottom portions thereof. The base portion 11 further includes upper and lower recesses 116, 117 extending forwardly and communicating with the respective upper and lower receiving cavities 110, 111. A pair of posts 118 projects downwardly from a bottom surface of the housing 1 for securing the electrical connector assembly 100 to the motherboard. The extending portion 12 includes an upper wall 121 and two opposite extending arms 122 extending rearwardly.

The insert module 200 includes an insulator 2, a ground plate 3 and a plurality of first and second terminal modules 4, 5 attached to the insulator 2. The insulator 2 includes a front section 21, a rear section 22 and a groove 23 between upper portions of the front and rear portions 21, 22. The front section 21 defines a plurality of front mounting holes 211 extending through upper and lower surfaces of the front section 21 and a chamber 24 exposed in a front face thereof. The front section 21 also has a ladderlike fixing portion 25 extending upwardly from opposite sides of the front section 21 for securing the first and the second terminal modules 4, 5 thereto, as will be discussed hereinafter further. The fixing portion 25 includes a step surface 252, an arcuate guiding surface 251 below the step surface 252, an embossment 253 projecting from the guiding surface 251 and a protrusion 254 extending upwardly from top surface of the fixing portion 25. The rear section 22 defines a plurality of rear mounting holes 221 extending through an upper and a lower surface thereof.

The ground plate 3 is stamped from one metal sheet and includes a vertical portion 32, a horizontal portion 31 extending forwardly from a top end of the vertical portion 32 and a pair of flaps 33, 34 extending forwardly from opposite sides of the vertical portion 32. Each flap 33, 34 forms a grounding tail 331, 341 projecting downwardly for electrically connecting with the motherboard.

The first terminal module 4 comprises a first internal PCB 42, a plurality of first mating terminals 41 and first mounting terminals 43. Each first mating terminal 41 includes a horizontal retention portion 412 soldered on the first internal PCB 42 and a contact portion 411 extending upwardly from the retention portion 412 and being angled inwardly toward the first internal PCB 42. The first internal PCB 42 defines a pair of locking hole 421 on opposite sides therein for engaging with the protrusions 254 of the fixing portion 25 and a plurality of first soldering holes 422 for soldering the first mounting terminals 43 therein. It should be noted that the first internal PCB 42 may include one or more signal conditioning components (not shown) mounted thereon for signal conditioning, and thus reducing the interference between transmitting signals.

The second terminal module 5 includes a second internal PCB 52, a plurality of second mating terminals 51 and second mounting terminals 53. The first and the second terminals 41, 51 are identical in configuration and structure except that they are oriented on opposite directions of the first and second internal PCBs 42, 52. Each second mating terminal 51 includes a horizontal retention portion 512 mounted on the second internal PCB 52 and a contact portion 511 extending downwardly from the retention portion 512 at an angle relative to the second internal PCB 52. The second internal PCB 52 defines a pair of cutouts 521 on opposite sides therein for engaging with the embossments 253 of the fixing portion 25 and a plurality of second soldering holes 522 for soldering the second mounting terminals 53 therein. As such, the second internal PCB 52 includes one or more signal conditioning components (not shown) mounted thereon for compensating the attenuation of signals.

Referring to FIGS. 3 through 6, in assembly, the first and the second mating terminals 41, 51 are soldered on the first and the second internal PCBs 42, 52 respectively. The second mounting terminals 53 are inserted into the appropriate front mounting holes 211, respectively. The second internal PCB 52 having the second mating terminals 51 soldered thereon is pressed downwardly into the front section 21 of the insulator 2 along the guiding surface 251 thereafter. The embossments 253 of the insulator 2 are held in the cutouts 521 of the internal PCB 52 by a interference fit, thereby stabilizing the second mounting terminals 53 extending through respective one of the second soldering holes 522 and soldering on the second internal PCB 52. It is important to note that a distal end of contact portion 511 of each second mating terminal 51 is received in the chamber 24 for minimizing whole dimension of the insert module 200. The ground plate 3 is attached to the insulator 2. The vertical portion 32 of the ground plate 3 is installed in the groove 23, while the horizontal portion 31 is in juncture with the step surface 252 and extends forwardly beyond a front portion of the insert module 200 for avoiding connecting with the second mating terminals 52 therebetween. The flaps 33, 34 of the ground plate 3 are pressed against to opposite sides of the insulator 2. The first mounting terminals 43 are inserted into the appropriate rear mounting holes 221. The first internal PCB 42 with the first mating terminals 41 soldered thereon is secured to the insulator 2. The protrusions 254 are retained in the respective locking hole 421. And thus, the first mounting terminals 43 extend through the first soldering holes 422 and soldered on the first internal PCB 42, thereby forming the insert module 200.

The insert module 200 is assembled to the housing 1 in a back-to-front direction. The horizontal portion 31 of the ground plate 3 is insert into the slot 1121 of the panel 112. The first and the second terminal modules 4, 5 extend into the respective upper and lower recesses 116, 117 and extend forwardly where the contact portions 411, 511 of the first and section terminal module 4, 5 are exposed in the corresponding upper and lower receiving cavities 110, 111 for being mated. It is noted that the first and the second terminal modules 4, 5 can be shielded fully through the ground plate 3 secured therebetween, and the attenuation between the input and the output high-speed signals can be compensate by the first and the second internal PCBs 42, 52, and thus the crosstalk between the high-speed signals can be eliminated rapidly.

It is to be understood, however, that even though numerous, characteristics and advantages of the present invention have been set fourth in the foregoing description, together with details of the structure and function of the invention, the disclosed is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector assembly adapted for being mounted on a motherboard, comprising:

an insulative housing having two receiving cavities; and an insert module received in the housing, the insert module including an insulator, a first and a second terminal modules secured to the insulator and a ground plate secured between the first and the second terminal modules, the first and the second terminal modules respectively having first and second mating terminals extending into a corresponding receiving cavity wherein the insulator of the insert module is unitarily formed and includes a front section, a rear section and a groove between upper portions of the front and the rear sections, the groove for receiving the ground plate.

2. The electrical connector according to claim 1, wherein the first and the second terminal modules respectively secured in the front and the rear sections of the insulator.

3. The electrical connector according to claim 2, wherein the ground plate includes a vertical portion retained in the groove of the insulator and a horizontal portion extending between the first and the second mating terminals of the first and the second terminal modules.

4. The electrical connector according to claim 3, wherein the first terminal module includes a first internal PCB and a plurality of first mounting terminals retained in the rear section of the insulator, said first mating terminals being soldered on the first internal PCB and connecting with the first mounting terminals through circuit traces on the first internal PCB, and wherein the second terminal module includes a second internal PCB and a plurality of second mounting terminals retained in the front section of the insulator, said second mating terminals being soldered on the second internal PCB and connecting with the second mounting terminals through circuit traces on the second internal PCB.

5. The electrical connector assembly according to claim 4, wherein the first and the second internal PCBs are mounted on the insulator at different heights.

6. The electrical connector assembly according to claim 4, wherein the insulator includes an embossment for positioning the second internal PCB, a step surface for supporting the ground plate thereon and a protrusion for positioning the first internal PCB.

7. The electrical connector assembly according to claim 3, wherein the ground plate further includes a pair of flaps extending forwardly from opposite sides of the vertical portion and bearing against opposite sides of the insulator, each flap having a grounding tail projecting downwardly for electrically connecting with the motherboard.

8. The electrical connector assembly according to claim 1, wherein the front section of the insert module defines a chamber in a front portion thereof, and a distal end of each second mating terminal is received in the chamber.

* * * * *